US005826405A

United States Patent [19]

Killinger et al.

[11] Patent Number: 5,826,405

[45] Date of Patent: Oct. 27, 1998

[54] METHOD AND APPARATUS FOR OPENING TAPED BAGS

[75] Inventors: Glenn W. Killinger; Gregory E. McDonald, both of Simpsonville; Charles C. Zende, Greer, all of S.C.

[73] Assignee: W. R. Grace & Co.-Conn, Duncan, S.C.

[21] Appl. No.: 857,277

[22] Filed: May 16, 1997

[51] Int. Cl.[6] ..... B65B 43/30; B65B 43/36; B65B 43/12; B65B 43/52

[52] U.S. Cl. ..... 53/459; 53/570; 53/573; 53/385.1; 53/386.1; 141/114

[58] Field of Search ..... 53/459, 570, 385.1, 53/386.1, 468, 469, 573; 141/10, 313, 114, 166

[56] References Cited

U.S. PATENT DOCUMENTS

| | | | |
|---|---|---|---|
| 997,193 | 7/1911 | Hoyt . | |
| 2,601,480 | 6/1952 | Williams | 226/49 |
| 2,702,150 | 2/1955 | Vogt | 53/570 |
| 2,914,895 | 12/1959 | Martin . | |
| 3,059,550 | 10/1962 | Wellman . | |
| 3,161,347 | 12/1964 | Hannon | 53/459 |
| 3,501,888 | 3/1970 | Egli et al. . | |
| 3,552,090 | 1/1971 | Roberts et al. | 53/570 X |
| 3,579,948 | 5/1971 | Lerner | 53/459 |
| 3,587,843 | 6/1971 | Wing | 206/57 |
| 3,740,922 | 6/1973 | Liou . | |
| 3,793,797 | 2/1974 | Roberts et al. | 53/459 |
| 3,804,322 | 4/1974 | Ericson | 229/53 |
| 3,908,343 | 9/1975 | Farrelly | 53/570 X |
| 4,137,958 | 2/1979 | Golby et al. | 150/1 |
| 4,248,032 | 2/1981 | Woods et al. | 53/570 |
| 4,484,904 | 11/1984 | Fowler | 493/213 |
| 4,516,384 | 5/1985 | Imperiale | 53/459 |
| 4,674,268 | 6/1987 | Gavronsky et al. | 53/469 X |
| 4,795,413 | 1/1989 | Johnson et al. | 493/309 |
| 5,551,215 | 9/1996 | McDonald et al. | 53/459 |

*Primary Examiner*—Horace M. Culver
*Attorney, Agent, or Firm*—Mark B. Quatt

[57] ABSTRACT

A method of opening a bag includes the steps of providing a bag including a first panel, a second panel, a first bag edge, a second bag edge, a bag bottom, and a bag mouth; holding the bag mouth between a first means for vacuumizing and a second means for vacuumizing; moving the first and second means for vacuumizing such that the bag mouth disengages from the tape; activating the first and second means for vacuumizing to draw a vacuum through said means; and further moving the first means for vacuumizing such that the bag mouth opens. In an alternative method, instead of holding the bag mouth with the vacuumizing means, the vacuumizing means can be brought into close proximity to the bag mouth, and activated to draw each panel of the bag mouth to a respective vacuumizing means. Thereafter, both vacuumizing means can be moved upward, and the bag mouth opened. An apparatus for opening a bag is also disclosed.

25 Claims, 6 Drawing Sheets

METHOD AND APPARATUS FOR OPENING TAPED BAGS

FIELD OF THE INVENTION

The present invention relates to a method and apparatus for opening taped bags, especially taped bags arranged in an imbricated manner.

BACKGROUND OF THE INVENTION

Many packaging applications, especially food packaging, require or benefit from the use of bags made from various thermoplastic materials and structures. Examples of commercial bags include heat shrinkable bags supplied by the Cryovac Division of W. R. Grace & Co.-Conn., including the "If", B110, and B2550 bags.

These bags are commonly used in large scale meat processing and/or packaging systems where production speed and efficiency are important. Bags to be used in these systems are often themselves packed in boxes, the individual bags taped together so that they will feed in a predictable and efficient manner to an article loading station. Typical of such technology is U.S. Pat. No. 3,161,347 (Hannon), disclosing a tape to which bags are attached, and U.S. Pat. No. 3,587,843 (Wing), incorporated herein by reference in its entirety, disclosing two tapes to which are attached imbricated (i.e. shingled) bags.

At the loading station of a conventional system, each bag is opened and then loaded with an article such as a fresh red meat subprimal or smoked and processed meat, poultry, cheese, or other perishable food product, or other product.

One problem sometimes encountered is that of bag lips (the edges of the bag panels which form the bag opening) which can be undesirably stuck together, or stuck to the adhesive bag tapes. This occurs in conjunction with the use of adhesive tapes to hold a series of imbricated (shingled) bags. Lateral movement of the top ply of the lead bag relative to the bottom ply can cause the top ply of the bag to adhere to the adhesive tape, making it difficult to open the bag. This can create a significant slow-down in a packaging line, and down-time for the food processor or other user of bags. The bags can of course be opened manually, but this is very slow and labor intensive. It also risks unnecessary handling of the bag.

Some solutions have been offered to deal with the problem of opening a bag prior to the insertion of an article into the bag. The use of air pressure is common, but of course requires a source of air pressure. Sometimes the use of air pressure is unpredictable in providing consistent bag opening performance, and the operator sometimes still needs to manually start the opening process so that the air can be effective in further opening the bag sufficiently to allow an article to be loaded therein.

Another problem inherent in conventional bag loading systems is the requirement to match center to center tape spacing to the bag size and article cross section. "Tape spacing" here refers to the pair of adhesive carrier tapes, e.g. as described in the '843 Wing patent, which in many commercial bag loading systems hold bags together in an imbricated manner before loading with an article. Currently, the nature of the tape spacing will generally define the shape of the bag when it is opened. Since the bag dimensions are ideally matched to the dimensions of the article to be packaged, tape spacing is an important parameter in loading a bag with an article.

It is desirable to provide a method and bag which lessen or eliminate the requirement of opening the bag manually, or of using air pressure. It is also desirable to provide a method of opening the bag in a reliable and consistent manner, which allows for increased automation, and potentially reduces operating costs.

Likewise, it is desirable to provide a method and bag which lessen or eliminate the requirement of matching tape spacing to article size, i.e. the requirement of optimizing tape spacing for feeding or indexing the bags.

Another problem often encountered in the packaging of food products is that the corners of each bag tend to curl over during bag advance and loading. This can sometimes complicate or slow the bag loading process. By finding a way to widen the tape spacing, that is, by placing the tapes closer to the bag's respective lateral edges, without being unduly limited in the need to match tape spacing to bag and article size, this problem is lessened or eliminated.

SUMMARY OF THE INVENTION

In a first aspect, a method of opening a taped bag comprises providing a bag comprising a first panel a second panel, a first bag edge, a second bag edge, a bag bottom, and a bag mouth; holding the bag mouth between a first means for vacuumizing and a second means for vacuumizing; moving the first and second means for vacuumizing such that the bag mouth disengages from the tape; activating the first and second means for vacuumizing to draw a vacuum through said means; and further moving the first means for vacuumizing such that the bag mouth opens.

In a second aspect, a method of opening a taped bag comprises providing a bag comprising a first panel, a second panel, a first bag edge, a second bag edge, a bag bottom, and a bag mouth; providing a first means for vacuumizing and a second means for vacuumizing; moving the first and second means for vacuumizing into close proximity to the bag mouth; activating the first and second means for vacuumizing to draw a vacuum through said means, such that the first panel is held by the first means for vacuumizing, and the second panel is held by the second means for vacuumizing; and moving the first and second means for vacuumizing such that the bag mouth disengages from the tape, and the bag mouth opens.

In a third aspect, an apparatus for opening a taped bag, the bag having a first panel, a second panel, a first bag edge, a second bag edge, a bag bottom, and a bag mouth, comprises a first means for vacuumizing, the means disposed on a first side of the bag; and a second means for vacuumizing, the means disposed on a second side of the bag; wherein the first and second means for vacuumizing are operable to hold the bag mouth, to disengage the bag from the tape, and to open the bag.

BRIEF DESCRIPTION OF THE DRAWINGS

In the drawings presented by way of illustration of the invention.

DESCRIPTION OF THE PREFERRED EMBODIMENTS

Figure 1:
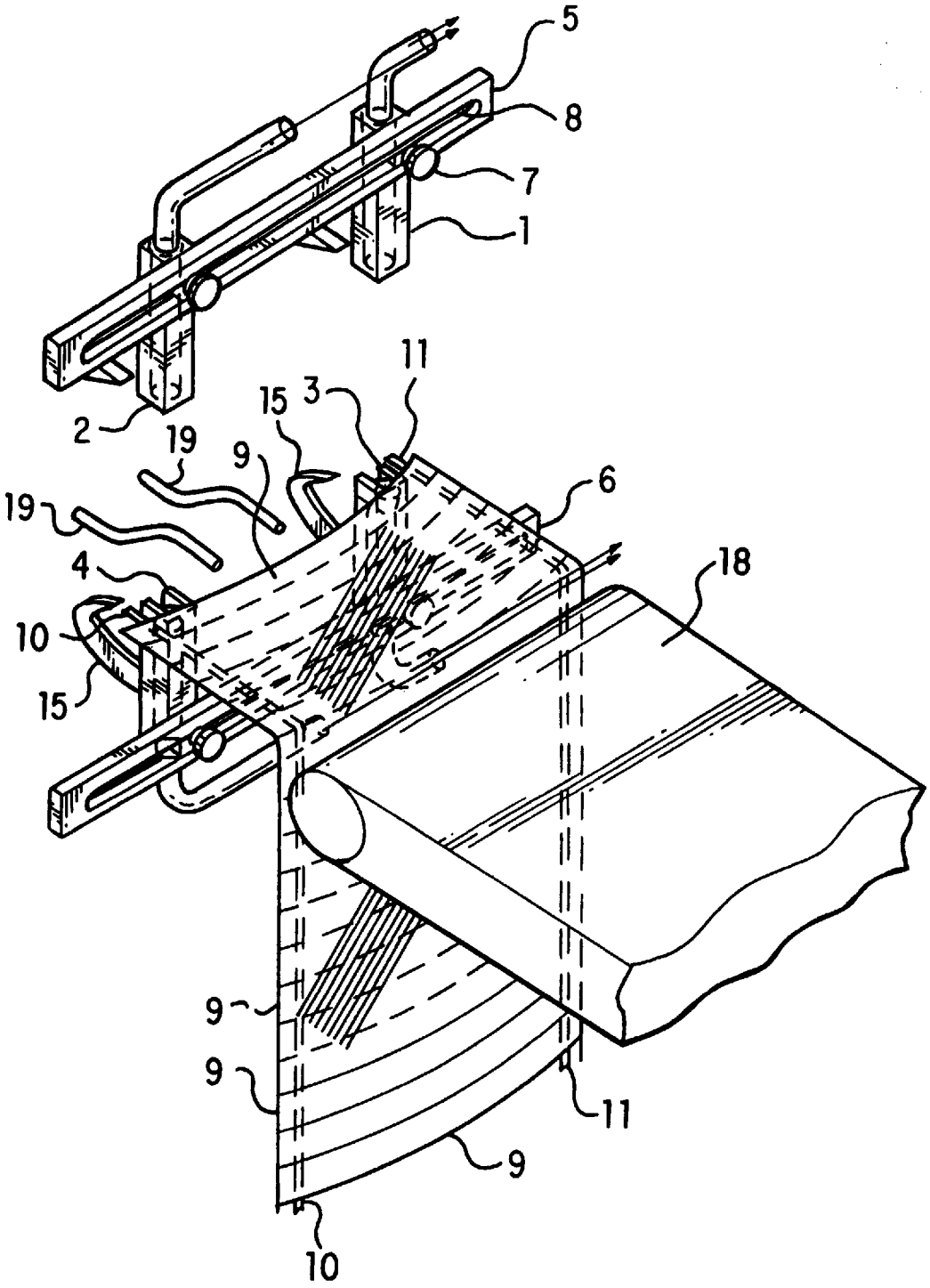
FIG.1 is a perspective view of an apparatus and method of opening a bag, wherein the bag has been advanced to a means for supporting the bag.

FIG. 1 discloses features of the apparatus and method of the invention and their relative position prior to initiating opening of the bag mouth.

The apparatus includes vacuum cup assemblies 1 and 2 mounted to horizontal support bar 5 and vacuum cup assemblies 3 and 4 mounted to horizontal support bar 6. The attachment of vacuum cup assembly 1 to the horizontal support bar 5 is made with hand knob 7. By loosening the hand knob 7, the assembly 1 can be moved horizontally toward vacuum cup assembly 2. The movement is constrained by the threaded stud of the hand knob in slot 8. Similar adjustments can be made for vacuum cup assemblies 2,3 and 4.

Horizontally intersecting the vertical plane defined by the vacuum cup assemblies, and between the horizontal support bars 5 and 6, lies leading bag 9 attached to tapes 10 and 11. The bag 9 shown is the topmost bag of a series of imbricated taped bags 9. Also shown are the product receiving station 18, which can be a conveyor or table, and bag bottom straightening nozzles 19.

A bag 9 typically includes a first panel or top panel 21 (see FIG. 6), and a second or lower panel (not shown). Each panel can be regarded as having a first and second end, and a first and second edge. As viewed in a substantially lay-flat condition, the two panels each preferably have substantially the same length and width. Respective communicating first edges of the first and second panels form a first bag edge 23. A second bag edge 24 is formed by respective communicating second edges of the first and second panels. A bag bottom 25 is formed by respective communicating first ends of the first and second panels. A bag mouth 17 is formed by respective second ends of the first and second panels.

Bags currently are typically made as side seal bags or end seal bags.

The side seal bag will have a factory-made heat seal at opposite bag edges. The bag bottom will be formed by the fold of film created during the extrusion of bag tubing during manufacture. The opposite fold of film is slit to form a bag mouth.

An end seal bag will have opposite bag edges formed by the fold of film created during the extrusion of bag tubing during manufacture. The bag bottom will be a heat seal. The bag mouth is formed by a transverse cut in the extruded tubing.

In both of these cases, the bag is typically made from a long length of bag tubing.

It is of course possible to use this invention with other embodiments, such as two discrete film panels which are of substantially the same size, and brought together and sealed along two edges and the bottom to form a bag. Thus, although each panel (i.e. major wall) of the bag can be regarded as having a first end, first and second edges, and a second end, and although the bag edges are described as being joined portions of respective edges of the first and second panels of the bag, it will be understood that in fact a particular bag edge, or bag bottom, can be formed either from a true seal between two webs or panels of film, or from a fold of an originally single web of film, such as the tubular extruded "tape" typical of many film making operations.

Other components typical of a bag loading system can be used with benefit in connection with the present invention. These are well known and conventional and need no further description for those skilled in the art.

Figure 2:
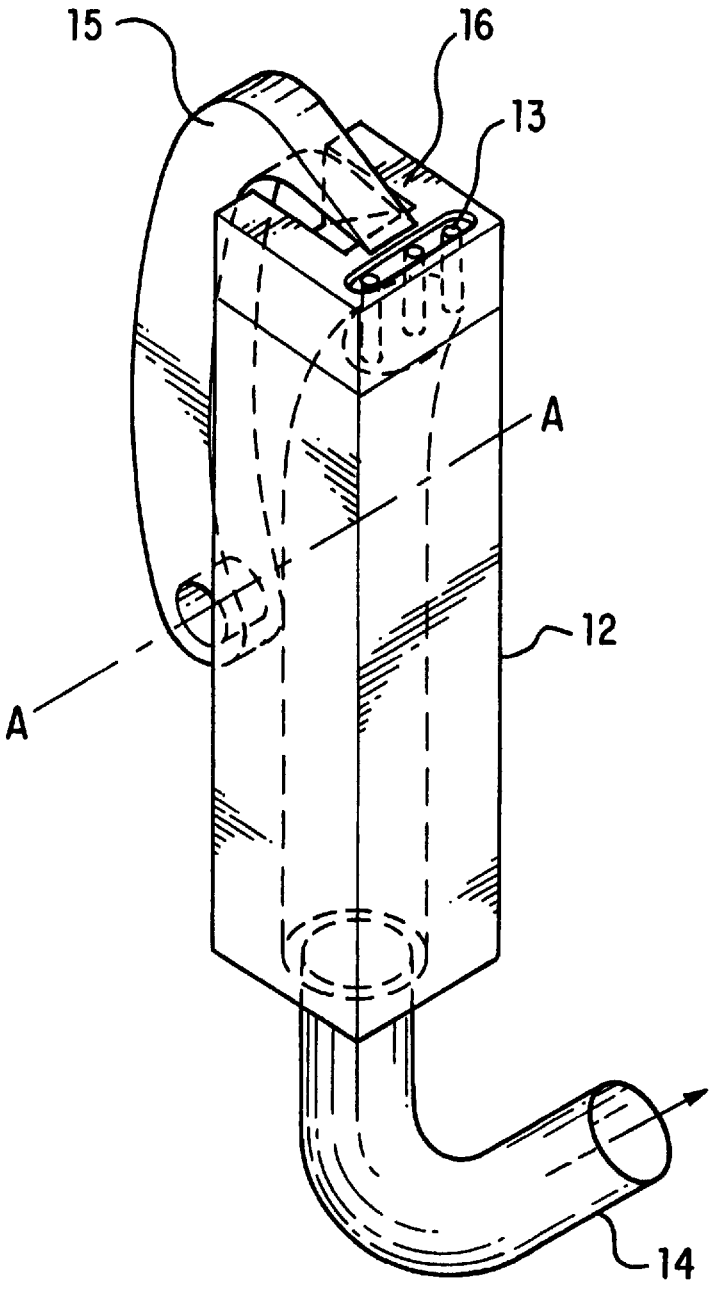
FIG. 2 is a perspective view of a means for vacuumizing.

With reference to FIG. 2, each of the vacuum cup assemblies 1, 2, 3, and 4 includes a hollow body 12, an integral vacuum port 13, a vacuum supply line 14, and a clamp 15 which can rotate around axis A—A to contact the clamp anvil area 16 integral to the body 12.

Utilizing the embodiment and bag positioned as described in FIG. 1, an imbricated taped bag can be opened by the following process.

Figure 3:
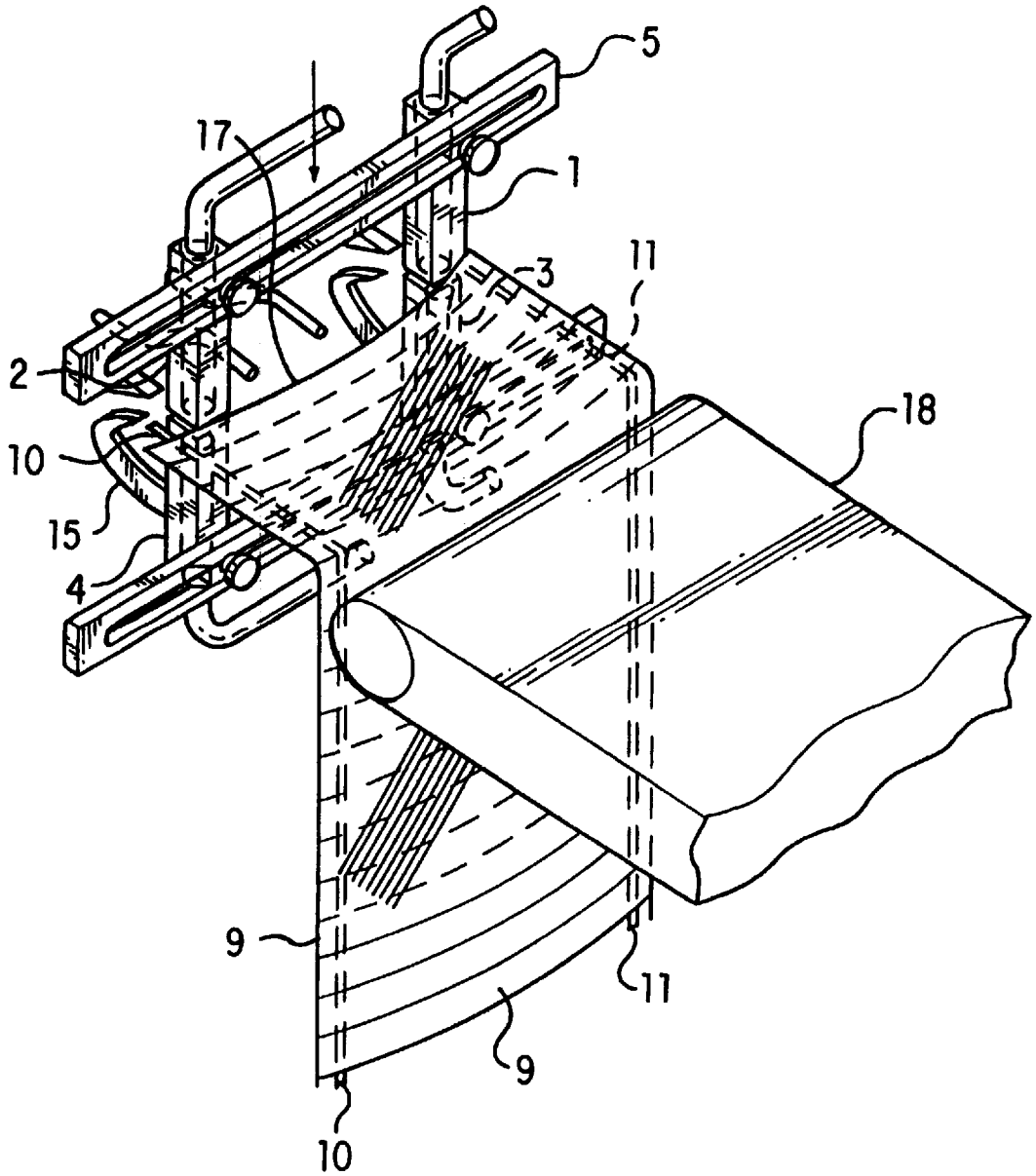
FIG. 3 is a perspective view of an apparatus and method of opening a bag, wherein the bag is held by a first and second means for vacuumizing.

First, horizontal support bar 5 moves downward allowing vacuum cup assemblies 1 and 2 to contact the lead bag 9. Preferable horizontal alignment of vacuum cup assemblies is such that a least a portion of vacuum cup assembly 1 overlaps vacuum cup assembly 3, pinching the bag 9 between vacuum cups assemblies 1 and 3 in an area between tapes 10 and 11 near the bag mouth 17 as shown in FIG. 3. A similar arrangement and operation applies for vacuum cup assemblies 2 and 4.

Figure 4:
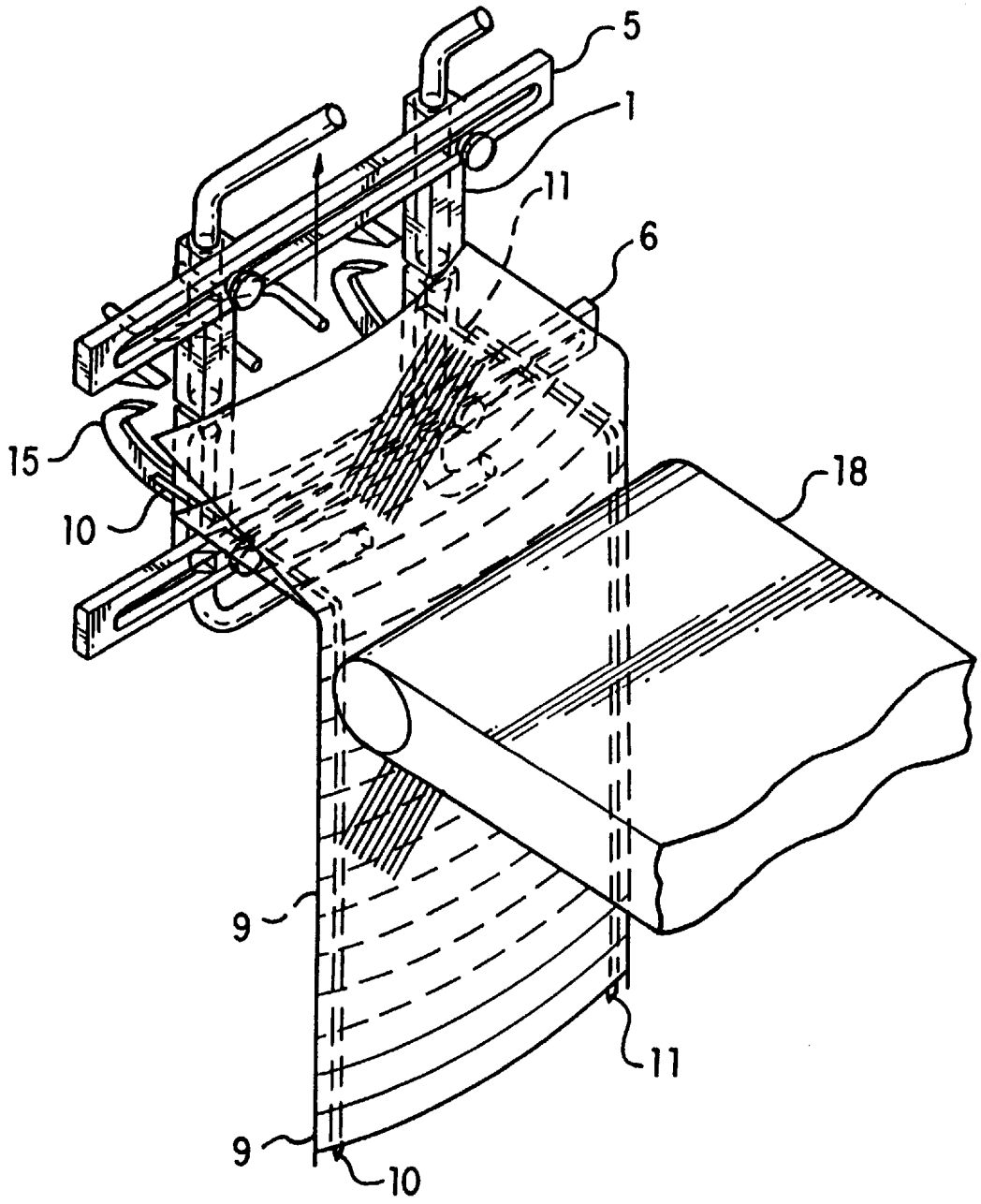
FIG. 4 is a perspective view of an apparatus and method of opening a bag, wherein the bag mouth has been detached from the tapes by moving the bag mouth away from the tapes.

Next, horizontal support bars 5 and 6 synchronously move vertically upward a suitable distance, preferably between about 0.5 and 1.5 inches, such as about 1 inch, thus maintaining control of the bag lip, while detaching the bag from tapes 10 and 11 as shown in FIG. 4. Vacuum is then applied to the vacuum ports, thus securing the bag to the vacuum cups.

Figure 5:
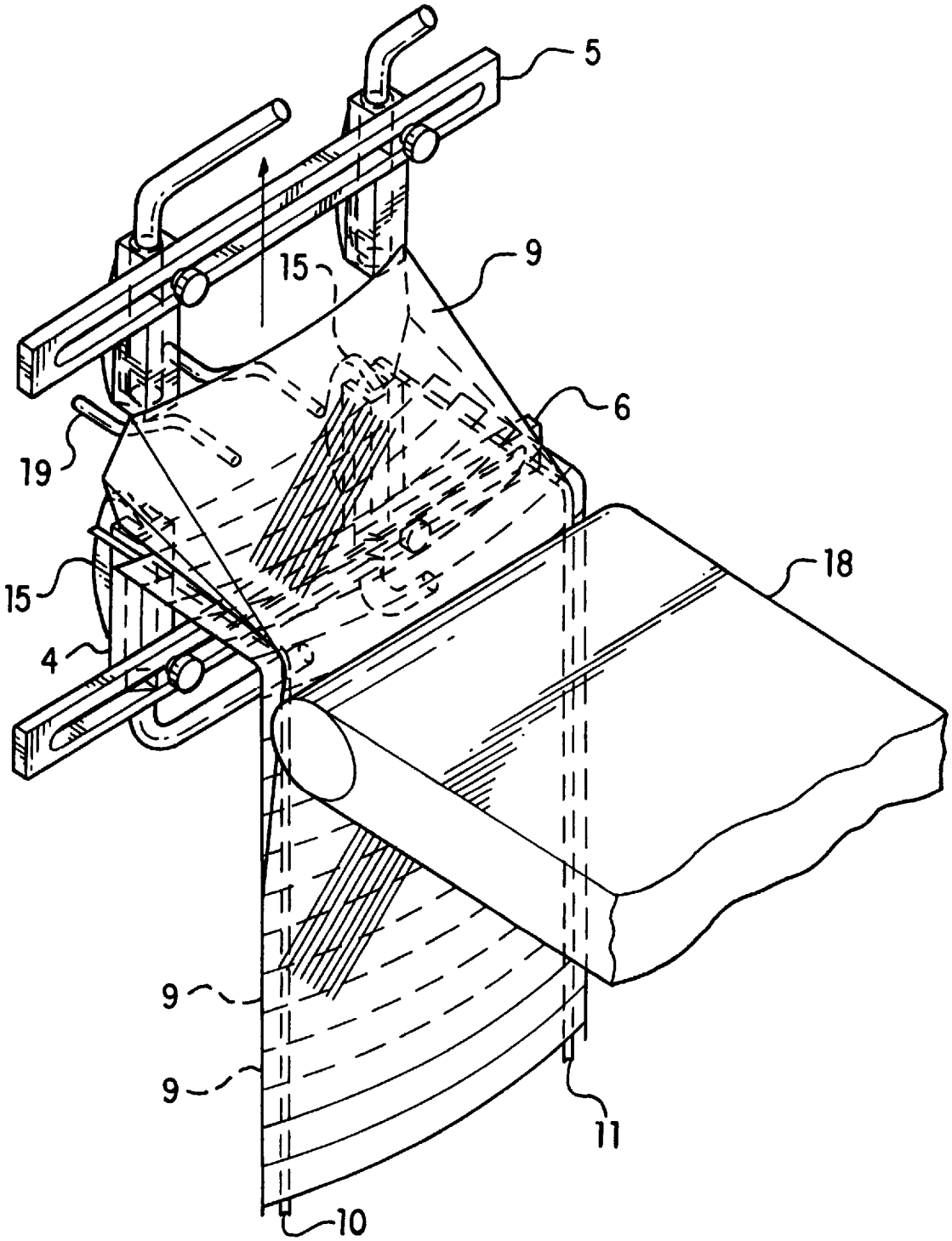
FIG. 5 is a perspective view of an apparatus and method of opening a bag, wherein the bag mouth has been opened.

Then, with the bottom horizontal support bar 6 held stationary, top horizontal support bar 5 moves further vertically upward. With the bag 9 secured to the vacuum cup assemblies by the vacuum nozzles, the bag mouth 17 is opened as shown in FIG. 5.

Optionally, as the horizontal support bar 5 moves upwardly as described, clamps 15 rotate from their open position as shown in FIG. 2, thus clamping the bag 9 against clamp anvil area 16.

Figure 6:
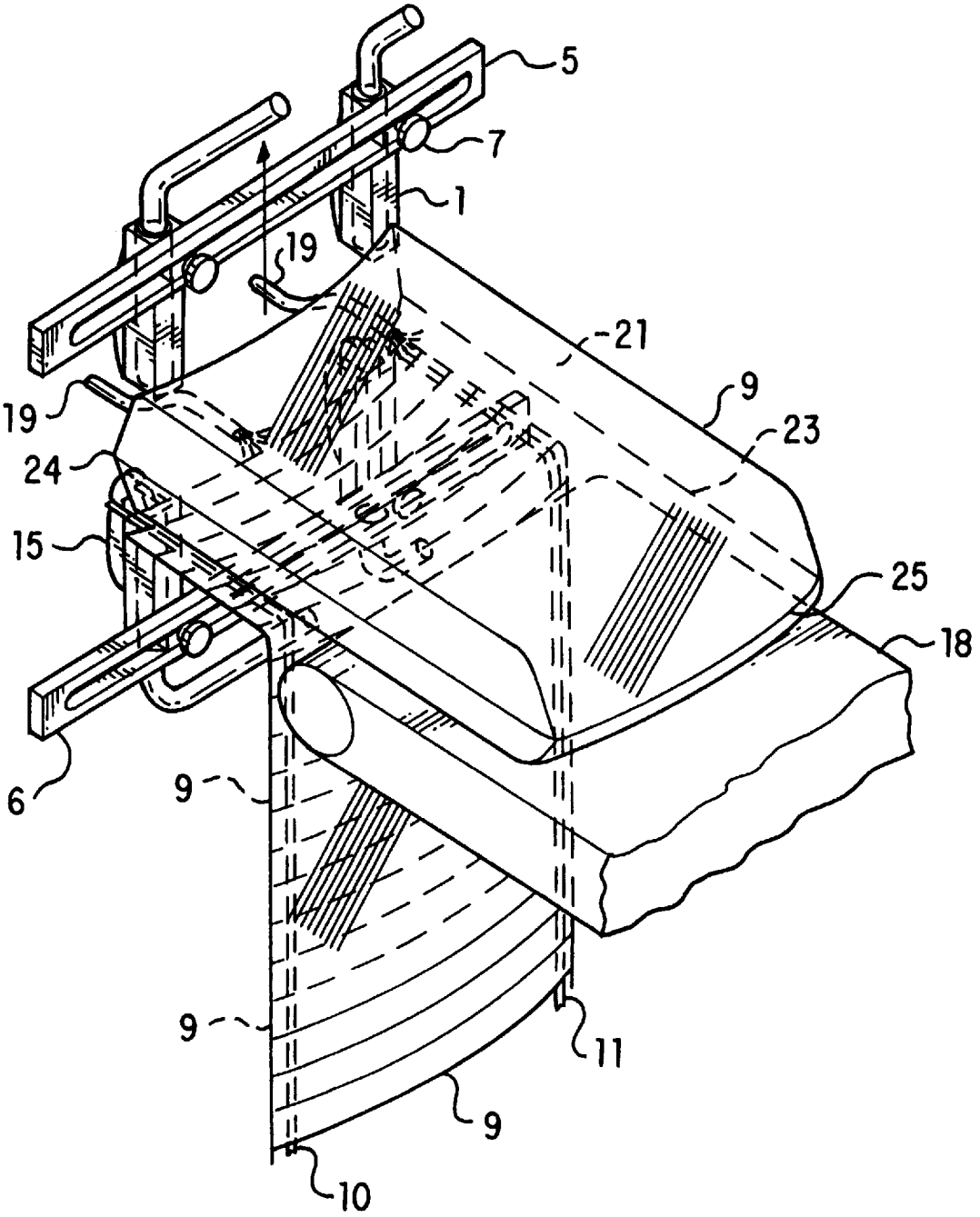
FIG. 6 is a perspective view of an apparatus and method of opening a bag, wherein the bag bottom has been straightened.

Optionally, with the bag opened, bag bottom straightening nozzles 19 can be activated, and pressurized air or other fluid forced through the nozzles and onto or into the bag, thereby forcing the bag bottom out and onto the product receiving station 18 as shown in FIG. 6.

Optionally, after the bag mouth has been opened by any of the aforementioned procedures, a horn can be inserted into the bag and expanded, thereby securing the bag while the bag bottom is being straightened.

With the bag opened, product, i.e. fresh red meat, poultry, smoked and processed meat, or other food or non-food product, can introduced into the bag by any appropriate means, e.g. manually placing the product into the bag, or using a horn to guide the product into the bag. This latter method is well known by the skilled artisan, and incorporated into the 8189 FRM bag loader available from the Grace Packaging (Cryovac) Group of W. R. Grace & Co.-Conn.

In an alternative embodiment to the process steps just described, the holding step described above can be eliminated by bringing the vacuum cup assemblies into close proximity to the bag, and activating the vacuum nozzles to draw a vacuum.

In this alternative embodiment, the two bag panels are held by respective activated vacuum assemblies, and the bag can be opened by two different modes.

In the first mode, after the two bag panels have been secured to respective vacuum means by activation of these vacuum means to pull a vacuum, all of the vacuum assemblies are drawn upward substantially the same distance to detach bag mouth 17 from tapes 10 and 11. Then, the top panel of the bag is drawn upward an additional distance, while keeping the bottom bag panel stationary, to open the bag mouth.

It will be understood that when the vacuum means are activated in the alternative embodiment, the two bag panels in the region of the bag mouth may slightly separate from each other as each panel is drawn to respective vacuum assemblies 1,2 and 3,4.

In the second mode of the alternative embodiment, after the two bag panels have been secured to respective vacuum means by activation of these vacuum means to draw a vacuum, both pairs of vacuum assemblies, i.e. 1,2 and 3,4 are drawn upward, but vacuum assemblies 1 and 2 are moved upward at a greater velocity than vacuum assemblies, 3 and 4. This differential movement of the top bag panel with respect to, and away from, the bottom bag panel, accomplishes both the detachment of the bag mouth from tapes 10 and 11, and opening of the bag mouth 17.

The present invention offers several advantages compared with conventional bag opening processes.

Removing the bag from the tape as described herein reduces the incidence of stuck bag lips.

Also, air inflation of the bag, although useable in connection with the invention, is no longer required.

In addition, the final dimensions of the bag opening are controlled by the horizontal spacing of the vacuum cup assemblies, and not by the tape spacing, eliminating the need to have multiple tape spacings for different product profiles, as is the case when inflating the bag on conventional opening systems.

Finally by removing the bag from the tape and straightening the bag tail, bag train disturbance is eliminated since the bag train is not required to support the weight of the product during loading.

A bag 9 as shown in the drawings can be one of a plurality of like bags stacked in imbricated (shingled) fashion in a bag loading system. An imbricated taped bag arrangement is well known in the art. Bags can be supported by a means for support such as a support platform (not shown), a table, or the like. When used in a vertical loading system, the adhesive tapes can themselves function as the means for supporting the bag, or a separate plate, baffle, or the like can be used, in any suitable orientation. Bags can be advanced by any suitable means, such as by a conventional taped bag indexer (not shown) e.g. that used in the 8189 system referred to herein, or any suitable device or process. The bags can be shingled "forward", i.e. the topmost bag in the stack of bags is furthest advanced or forward, and closest to the means for opening.

The opening of bag 10 can be continued by suitable supplemental devices. In some cases, it may be necessary to open the bag mouth 17 still further to allow for insertion of an article directly, or the insertion of loading horns (present in some bag loading operations) which in turn facilitate insertion of the article to be packaged, such as poultry or other food or non-food products.

Thus, supplemental fingers, loading horns, or the like can be inserted into the opening in the bag mouth made by the above described steps and apparatus.

An article such as a food article can thereafter be manually or mechanically loaded into the bag, and any subsequent packaging steps, such as vacuumizing, heat sealing, shrinking, etc. can be performed as desired.

Any films, especially thermoplastic films such as olefinic films with or without oxygen barrier functionality, can be used with benefit in this invention. These films are made by extrusion coating, coextrusion, lamination, or other suitable processes. Especially preferred for many applications are films comprising an outer layer, an intermediate layer, and an inner layer. The materials of the outer layer are often chosen for abuse resistance and/or sealability, and can be chosen from any suitable polymeric materials such as polyolefins, especially ethylenic polymers and copolymers, polypropylene, polyesters, polyamides, and the like. The inner layer materials, often chosen for sealability, can be any of the materials described for the outer layer. The intermediate layer materials are often chosen for their barrier qualities (i.e. barriers to oxygen, moisture, carbon dioxide, etc.). Preferred materials include polyvinylidene chloride polymers and copolymers, ethylene vinyl alcohol copolymer, polyvinyl alcohol, polyamide, polyester, acrylonitrile, and the like. Bags are preferably heat shrinkable, and preferably at least partially crosslinked.

It is to be understood that variations of the present invention can be made without departing from the scope of the invention, which is not limited to the specific embodiments and examples disclosed herein, but extends to the claims presented below.

Although the invention as described herein is preferably used in connection with taped bags (a very common commercial bag system), it can be beneficially used even without the use of adhesive tapes.

The methods and systems described and claimed herein can be used to advantage to make bags with panels of uneven length.

Although the invention has been illustratively described in the context of a system that includes bags vertically delivered to a horizontal support platform, the invention can also be beneficially used in a system in which the bags are vertically opened. In such an alternative embodiment, the vacuum assemblies will be positioned in substantially the same horizontal plane, and will draw the bag mouth away from the tapes in a substantially horizontal direction. After opening the bag mouth by further horizontal displacement of a first bag panel, product would be loading by dropping or lowering the product into an upwardly open bag mouth. Other orientations of the bag and apparatus, between horizontal and vertical, are also possible.

What is claimed is:

1. A method of opening a bag mounted on a tape comprises:

a) providing a bag comprising a first panel, a second panel, a first bag edge, a second bag edge, a bag bottom, and a bag mouth;

b) holding the bag mouth between a first means for vacuumizing and a second means for vacuumizing;

c) moving the first and second means for vacuumizing such that the bag mouth disengages from the tape;

d) activating the first and second means for vacuumizing to draw a vacuum through said means; and e) further moving the first means for vacuumizing such that the bag mouth opens.

2. The method of claim 1 further comprising, prior to step b), advancing the bag to a means for supporting the bag.

3. The method of claim 1 further comprising, after step e), clamping at least one panel of the bag in the vicinity of the bag mouth.

4. The method of claim 1 wherein the first means for vacuumizing is disposed above the bag, and the second means for vacuumizing is disposed below the bag.

5. The method of claim 1 further comprising, after step e), inserting a loading horn into the bag.

6. The method of claim 1 further comprising, after step e), blowing the bag bottom onto a loading platform.

7. A method of opening a bag mounted on a tape comprising:

a) providing a bag comprising a first panel, a second panel, a first bag edge, a second bag edge, a bag bottom, and a bag mouth;

b) providing a first means for vacuumizing and a second means for vacuumizing;

c) moving the first and second means for vacuumizing into close proximity to the bag mouth;

d) activating the first and second means for vacuumizing to draw a vacuum through said means, such that the first panel is held by the first means for vacuumizing, and the second panel is held by the second means for vacuumizing; and e) moving the first and second means for vacuumizing such that the bag mouth disengages from the tape, and the bag mouth opens.

8. The method of claim 7 further comprising, prior to step b), advancing the bag to a means for supporting the bag.

9. The method of claim 7 wherein, in step e), the first and second means for vacuumizing are moved in the same direction, at the same velocity, to detach the bag from the tape, and then the first means for vacuumizing is moved further to open the bag.

10. The method of claim 7 wherein the first and second means for vacuumizing are moved in the same direction, and the first means for vacuumizing is moved at a greater velocity than the second means for vacuumizing, causing the bag to detach from the tape, and causing the bag to open.

11. The method of claim 7 further comprising, after step e), clamping at least one panel of the bag in the vicinity of the bag mouth.

12. The method of claim 7 wherein the first means for vacuumizing is disposed above the bag, and the second means for vacuumizing is disposed below the bag.

13. The method of claim 7 further comprising, after step e), inserting a loading horn into the bag.

14. The method of claim 7 further comprising, after step e), blowing the bag bottom onto a loading platform.

15. An apparatus for opening a bag mounted on a tape, the bag having a first panel, a second panel, a first bag edge, a second bag edge, a bag bottom, and a bag mouth, comprising:

a) a bag path;

b) a first means for vacuumizing, the means disposed on a first side of the bag path; and c) a second means for vacuumizing, the means disposed on a second side of the bag path; wherein the first and second means for vacuumizing are operable to hold the bag mouth, to disengage the bag from the tape, and to open the bag.

16. The apparatus of claim 15 further comprising a means for supporting the bag.

17. The apparatus of claim 16 wherein the means for supporting the bag comprises a plate.

18. The apparatus of claim 16 wherein the means for supporting the bag comprises adhesive tape.

19. The apparatus of claim 15 further comprising a means for advancing the bag to the means for supporting the bag.

20. The apparatus of claim 19 wherein the means for advancing the bag comprises a bag indexer.

21. The apparatus of claim 15 wherein the first and second means for vacuumizing each comprise a plurality of vacuum cup assemblies movably arranged on a slotted support bar.

22. The apparatus of claim 15 wherein the first and second means for vacuumizing each comprise a vacuum cup and a clamp.

23. The apparatus of claim 15 further comprising a loading horn.

24. The apparatus of claim 15 further comprising a means for blowing the bag bottom onto a loading platform.

25. The apparatus of claim 15 wherein the first means for vacuumizing is disposed above the bag path, and the second means for vacuumizing is disposed below the bag path.

* * * * *